US010022762B2

(12) United States Patent
Emmert

(10) Patent No.: US 10,022,762 B2
(45) Date of Patent: Jul. 17, 2018

(54) DENT REPAIR SYSTEM

(71) Applicant: DentCraft Tools Limited Partnership, Oklahoma City, OK (US)

(72) Inventor: Sidney Quinn Emmert, Oklahoma City, OK (US)

(73) Assignee: Dentcraft Tools Limited Partnership, Oklahoma City, OK (US)

( * ) Notice: Subject to any disclaimer, the term of this patent is extended or adjusted under 35 U.S.C. 154(b) by 513 days.

(21) Appl. No.: 14/542,167

(22) Filed: Nov. 14, 2014

(65) Prior Publication Data

US 2016/0136705 A1 May 19, 2016

(51) Int. Cl.
*B21D 1/06* (2006.01)
*B25G 1/01* (2006.01)
*B25G 1/10* (2006.01)

(52) U.S. Cl.
CPC ..... *B21D 1/06* (2013.01); *B25G 1/01* (2013.01); *B25G 1/105* (2013.01)

(58) Field of Classification Search
CPC . B21D 1/06; B25G 1/105; B25G 1/00; B25G 1/10; B25G 1/102; B25G 1/01
See application file for complete search history.

(56) References Cited

U.S. PATENT DOCUMENTS 2,780,122 A * 2/1957 McCown ..... B21D 1/06 72/392
3,030,837 A * 4/1962 Chartier ..... B21D 1/06 29/275
3,208,317 A 9/1965 Duchesne
3,273,657 A * 9/1966 Willems ..... A22B 3/02 173/121
3,570,289 A * 3/1971 Smyers ..... B21D 1/06 173/91
3,605,521 A 9/1971 Glenn
4,073,181 A * 2/1978 Steinmann, Jr. ..... B21D 1/06 173/132
4,429,562 A * 2/1984 Hultquist ..... B21D 1/06 227/147
4,502,317 A * 3/1985 Hultquist ..... B21D 1/06 72/479
4,627,761 A 12/1986 Olson et al.
4,696,108 A 9/1987 Lay
5,385,420 A 1/1995 Newman et al.
5,433,552 A 7/1995 Thyu
5,461,900 A * 10/1995 Gutierrez ..... B21D 1/06 72/479
5,647,389 A 7/1997 Holloway
5,682,641 A * 11/1997 Newman, Jr. ..... B05C 17/0205 15/144.4

(Continued)

*Primary Examiner* — Monica Carter
*Assistant Examiner* — Danny Hong
(74) *Attorney, Agent, or Firm* — Hall Estill Attorneys at Law; Tyler J. Mantooth

(57) ABSTRACT

A dent repair system may have a gear with a body that has first and second end surfaces on opposite sides of a cylindrical shaped portion. A retention ring can continuously extend around the periphery of the cylindrical shaped portion between the first and second end surfaces with the retention ring having a sidewall that continuously extends from the cylindrical shaped portion in a radial direction with respect to the body. A tool may continuously extend from the body via a shaft.

20 Claims, 4 Drawing Sheets

(56) References Cited

U.S. PATENT DOCUMENTS

| | | | | |
|---|---|---|---|---|
| 5,730,023 | A * | 3/1998 | Gmeilbauer | B25D 1/00 72/479 |
| 5,749,271 | A | 5/1998 | Liu | |
| 6,170,123 | B1 | 1/2001 | Holland-Letz | |
| 6,485,031 | B2 | 11/2002 | Chen | |
| 6,543,270 | B2 * | 4/2003 | Cmelik | B21D 1/06 72/478 |
| 6,553,628 | B2 | 4/2003 | Newman et al. | |
| 6,588,304 | B2 | 7/2003 | Kady et al. | |
| 6,874,201 | B2 | 4/2005 | Ta et al. | |
| 7,156,003 | B2 | 1/2007 | Cole | |
| 8,250,899 | B2 * | 8/2012 | Janversan | B21D 1/06 72/325 |
| 2005/0252271 | A1 * | 11/2005 | Fredenberg | B21D 1/06 72/457 |

* cited by examiner

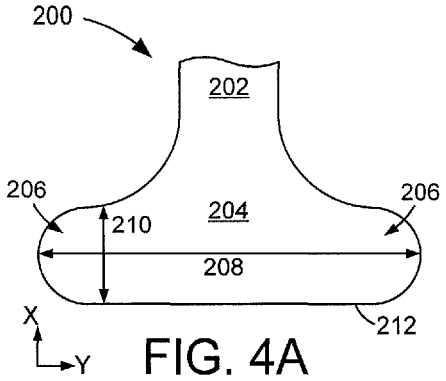
FIG. 4A
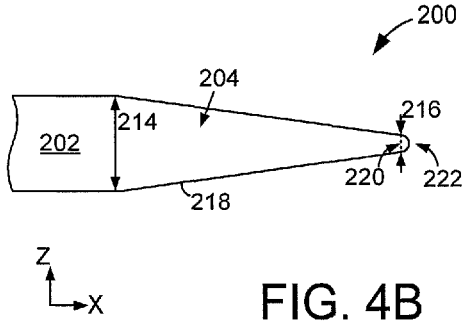
FIG. 4B
FIG. 5
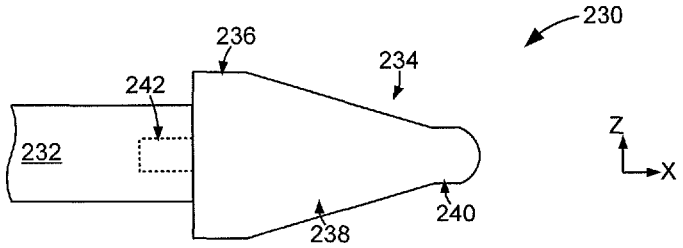
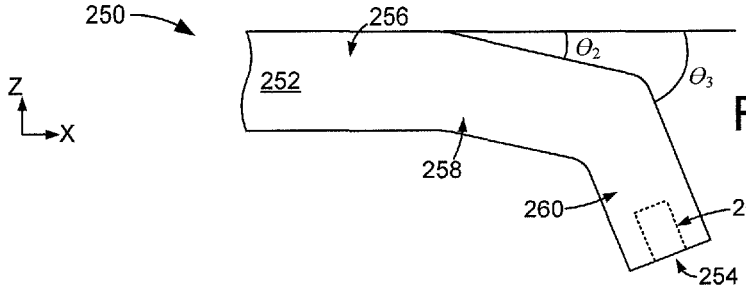
FIG. 6
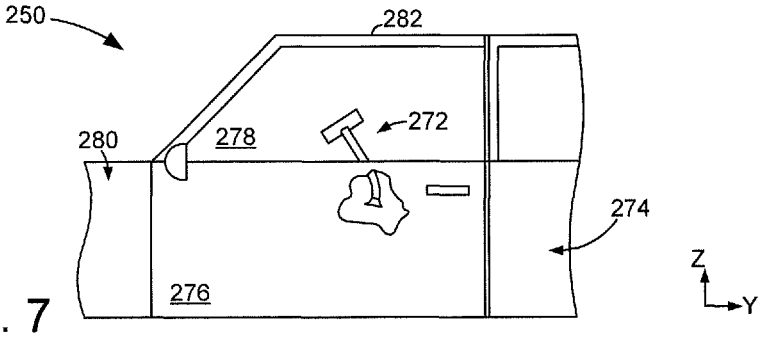
FIG. 7

DENT REPAIR SYSTEM

SUMMARY

A dent repair system may, in accordance with some embodiments, have a gear with a body that has first and second end surfaces on opposite sides of a cylindrical shaped portion. A retention ring can continuously extend around the periphery of the cylindrical shaped portion between the first and second end surfaces with the retention ring having a sidewall that continuously extends from the cylindrical shaped portion in a radial direction with respect to the body. A tool may continuously extend from the body via a shaft.

BRIEF DESCRIPTION OF THE DRAWINGS

FIGS. 4A and 4B respectively illustrate assorted views of a portion of an example dent repair tool configured in accordance with various embodiments.

FIG. 5 conveys a block representation of a portion of an example dent repair tool arranged in accordance with some embodiments.

FIG. 6 shows a block representation of a portion of an example dent repair tool configured in accordance with various embodiments.

FIG. 7 displays a block representation of an example dent repair tool operated in accordance with some embodiments.

DETAILED DESCRIPTION

Advancements in automobile, aircraft, and motorcycle materials and construction methods have resulted in vehicle bodies that are lighter, stronger, and more ornate. However, such vehicle bodies may be increasingly prone to dents and deformations due at least in part to thinner material layers compared to traditional vehicle panels. While various tools can precisely access and correct many vehicle dents and deformations despite thinner layers, the execution of dent repair can be laborious, tedious, and uncomfortable through two-handed articulation and rotation of a tool in a confined space. Hence, industry and consumer have interest in dent repair tools that can be accurately, comfortably, and efficiently positioned and operated to repair a dent or deformation in a vehicle panel.

With these issues and interest in mind, various embodiments are generally directed to a dent repair system employing a gear having a body with first and second end surfaces on opposite sides of a cylindrical shaped portion, a retention ring continuously extending around the periphery of the cylindrical shaped portion, and a tool continuously extending from the body via a shaft. The retention ring is positioned between the first and second end surfaces and has a sidewall that continuously extends from the cylindrical shaped portion in a radial direction with respect to the body. The configuration of the dent repair gear allows for selectively secure articulation of a tool while allowing selective rotation of the tool within a handle.

The configuration of the retention ring allows tool rotation to be conducted one-handed, which is ergonomically and operationally conducive to dent repairs on vehicle panels that are difficult and awkward to access. The ability to attach different tools with varying shapes, sizes, and purposes onto a dent repair gear allows efficient installation and replacement of different tools to a common handle. With the ability to selectively secure, loosen, rotate, and interchange a dent repair gear in a handle, a dent repair system can be provided with a single handle and a plurality of different dent repair gears that respectively provide tools capable of correcting surface deformation in a vehicle body panel.

Figure 1A:
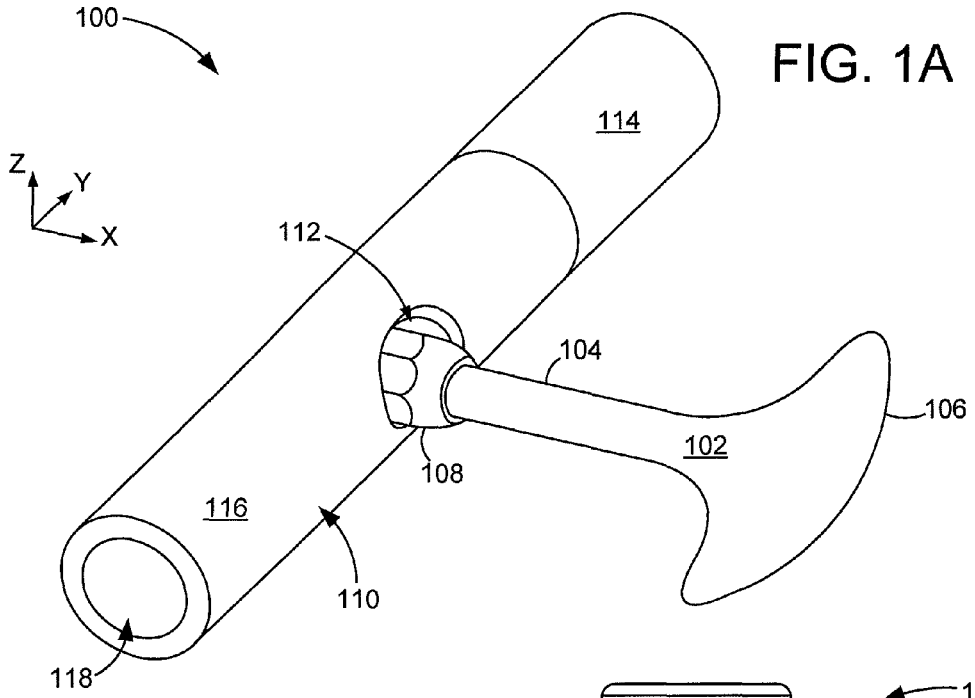
FIGS. 1A and 1B respectively provide assorted views of an example dent repair system configured and operated in accordance with various embodiments.
Figure 1B:
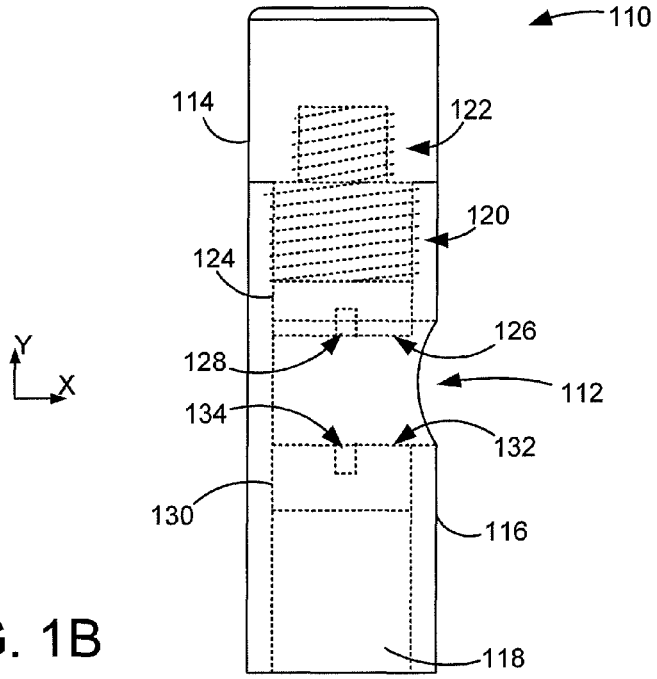

FIGS. 1A and 1B respectively show different views of an example dent repair system 100 configured to provide one-handed articulation and securing of a tool 102 in accordance with various embodiments. The tool 102 continuously extends from a shaft 104 and is shaped with lateral protrusions extending along the Y axis and connected by a continuously curvilinear leading edge 106. The tool 102 is not limited to the shape, size, or number shown in FIG. 1A. For example, a plurality of differently shaped tools 102 can be separated while each extending from a common shaft 104. Regardless of the number and configuration of the various tools 102, the shaft 104 can continuously extend from a dent repair gear 108 that is housed within a handle 110.

It is contemplated that the dent repair gear 108, and connected tool 102, can be secured within and released from an aperture 112 via articulation of a knob 114. A shown, the aperture 112 and knob 114 are positioned on a handle body 116 that can be tuned for shape and size to comfortably and efficiently fit in a user's hand and allow one-handed operation of the knob 114. That is, the handle body 116 can be partially or completely linear, curvilinear, or a combination of the two to allow a user to rotate the knob 114 relative to the body 116 around the Y axis to secure and release the dent repair gear 108 from the aperture 112. The handle 116 may have one or more recesses 118 that can provide fastening points for accessories, such as an extension.

FIG. 1B displays a side view block representation of the handle 110 without the dent repair gear 108 and shaft 104. The internal features of the handle 110, as shown by segmented lines, illustrate how the knob 114 can have first 120 and second 122 threaded connections on a first longitudinal end of the handle body 116, along the Y axis. The threaded connections may, in some embodiments, have opposite orientations, which may be characterized as counterthreads, can allow relatively small rotational articulation, such as less than a half a turn, of the knob 114 to fully secure and disengage the dent repair gear 108 with a retention feature 124 The retention feature 124 can be configured with a retention surface 126 and notch 128 that respectively contact different portions of the dent repair gear 108.

The retention feature 124 can be configured to complement a retention plug 130 that has a plug surface 132 and plug recess 134 that can respectively contact the dent repair gear 108. It should be noted that the configurations of the retention feature 124 and plug 130 can have matching or different shapes and sizes that contact similar or dissimilar regions of the dent repair gear 108. The ability to tune the configuration of the gear 108 contacting surfaces and recesses allows for efficient engaging and disengaging of the dent repair gear 108 via articulation of the knob 114 with one hand. For instance, the first 120 and second 122 threaded connections can be tuned to provide a predetermined amount of longitudinal travel for the retention feature 124 that corresponds to a predetermined number of turns for the knob 114.

Figure 2A:
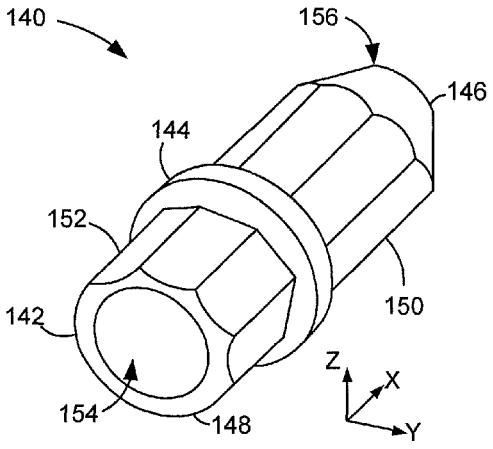
FIGS. 2A and 2B respectively show perspective and plan views of various portions of an example dent repair tool.
Figure 2B:
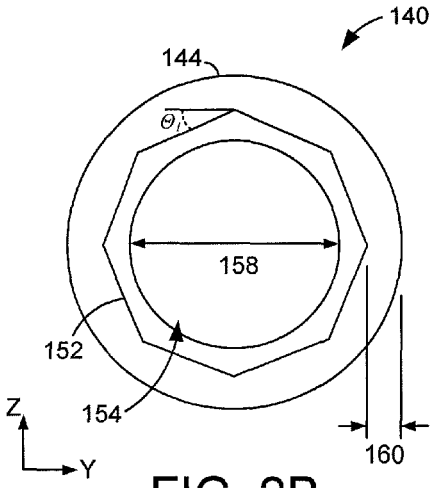

It is contemplated that the retention feature 124 and plug 130 are respectively tuned to secure the dent repair gear 108 is place via contact. The configuration of the dent repair gear 108 can also be tuned to allow rotation within the handle 110 while retaining the gear 108 within the handle body 116, even when the aperture 112 is facing downward. FIGS. 2A and 2B respectively convey perspective and plan views of an example dent repair gear 140 that has a tuned configuration in accordance with various embodiments. The dent repair gear 140 may be forged, cast, and assembled from one or more pieces of material to provide a gear body 142 and retention ring 144. The retention ring 144 can continuously extend about the periphery of the gear body 142 and be positioned at any location on the body 142 between first 146 and second 148 ends.

The position of the retention ring 144 may separate the exterior of the cylindrically shaped gear body 142 into first 150 and second 152 engagement surfaces. The exterior facing portions of the retention ring 144, first engagement surface 150, and second engagement surface 152 may be tuned to have a continuously curvilinear shape, like the retention ring 144 shown in FIG. 2A, or a plurality of different planar facets, like the engagement surfaces 150 and 152 shown in FIG. 2A. The faceted configuration of the engagement surfaces 150 and 152 increases the surface and contact area provided to the retention feature and plug of the dent repair handle. The number and orientation of the facets of the first 150 and second 152 engagement surfaces are not required to match and can be constructed with or without facets altogether.

The dent repair gear 140 may be solid, hollow, or a combination of the two. In the non-limiting example of FIGS. 2A and 2B, the gear 140 is hollow with an aperture 154 that extends from the second end 148 to the first end 146. The aperture 154 may be partially or completely filled by a shaft. In some embodiments, the first end 146 of the gear 140 is configured with a tapered tip 156, which may aid in the permanent attachment of a shaft within a bore with adhesive, weld, and solder. Through the tuned configuration of the various aspects of the dent repair gear 140, a tool attached to the gear can be selectively rotated and secured within a handle while providing enough rigidity and strength to allow relatively large amounts of force to be applied to a deformed vehicle panel.

In FIG. 2B, the aperture 154 has an inner diameter 158 that may be uniform or varying between the ends 146 and 148. The diameter 158 may be selected to provide a predetermined sidewall thickness that allows the second engagement surface 152 to be faceted at a particular angle $\theta_1$ while maintaining rigidity and strength against rotational and tensile forces. The retention ring 144 may be configured with a particular sidewall length 160 that extends from the engagement surface 152 to allow contact with the retention ring 144 without contacting the engagement surface 152. It should be noted that the retention ring 144 is not limited to a single sidewall length 160 as the ring 144 can have varying sidewall heights above the engagement surface 152 in various embodiments.

Figure 3A:
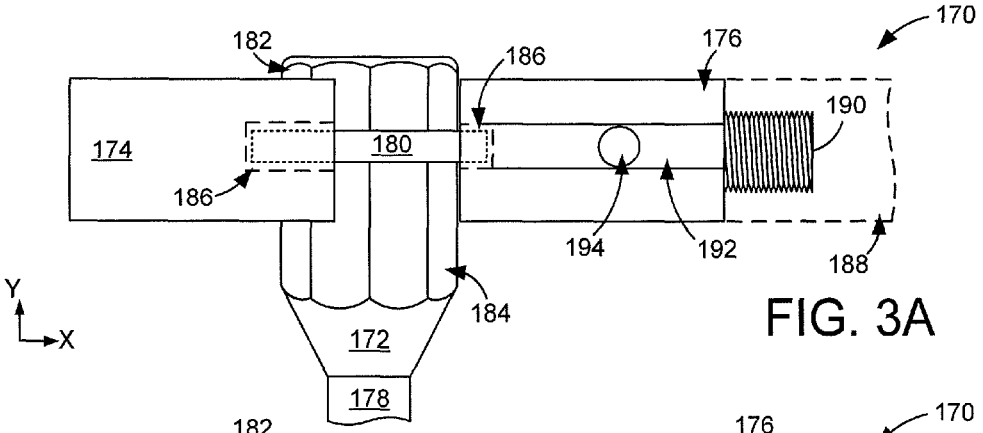
FIGS. 3A and 3B respectively are top view representations of portions of an example dent repair tool arranged in accordance with some embodiments.
Figure 3B:
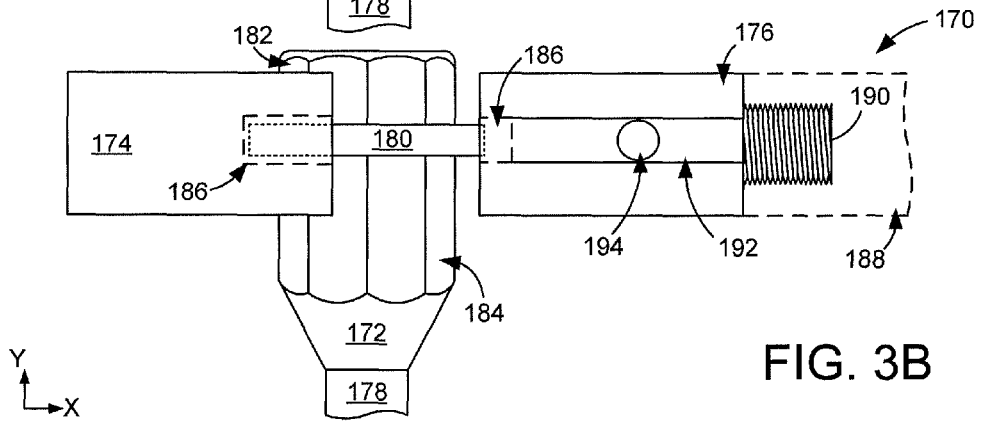

FIGS. 3A and 3B respectively illustrate portions of an example dent repair system 170 constructed and operated in accordance with some embodiments. FIG. 3A shows a dent repair gear 172 positioned between a stationary retention plug 174 and a retention feature 176. The dent repair gear 172 can have a shaft 178 extending along the X axis and a continuous peripheral retention ring 180 disposed between faceted first 182 and second 184 engagement surfaces. The retention plug 174 and feature 176 are each constructed with retention notches 186 having matching sizes and shapes to allow concurrent engagement with different portions of the retention ring 180. The retention notches 186 further allow securing physical contact between the retention plug 174, retention feature 176, and faceted engagement surfaces 182 and 184.

When a knob 188 is rotated to a first position about the Y axis relative to the handle body, the dent repair gear 172 is locked, as shown in FIG. 3A. The concurrent contact of the retention ring 180 by the retention notches 186 and engagement surfaces 182 and 184 by the respective retention plug 174 and feature 176 secures the dent repair gear 172 in place within the handle by preventing longitudinal, transverse, and rotational movement along the X and Y axes respectively. That is, the contact between the retention ring 180 retains the gear 172 within the handle while rotational movement is prevented by the concurrent contact of the facets of the first 182 and second 184 engagement surfaces.

In response to the knob 188 being rotated to a second position relative the handle body, as provided by the threads 190, the retention notches 186 maintain contact with the retention ring 180 while the retention feature 176 disengages the facets of the first 182 and second 184 engagement surfaces. By configuring the retention ring 180 to contact the notches 186 retains the gear 172 within the handle by preventing longitudinal movement along the X axis while disengagement of the retention feature 176 with the engagement surfaces 182 and 184 allows for the gear 172 to be rotated, either manually or automatically. Such tuned configuration allows a user to manipulate the knob 188 with one hand and rotate the gear 172 while the dent repair system 170 is pointing downward without concern for the gear 172 falling out of the handle. For instance, repairing a dent in an awkward location can be made considerably more efficient if a user can retain the handle with the gear 172 facing downward while rotating the knob 188 in one direction to allow the gear 172 to be rotated in a different second direction.

One or more recesses 192 in the retention feature 176 can be engaged by a guide pin 194 to restrict the retention feature 176 to motion along the Y axis. The configuration of the recess 192 can be tuned to ensure the retention notch 186 maintains an orientation with the retention ring 180 despite rotational articulation of the knob 188 and longitudinal movement of the retention feature 176. The guide pin 194 also can maintain the retention notch 186 orientation while the knob 188 is rotated in a first direction and the retention feature 176 moves in response to the threaded connection 190 pitch and orientation.

A comparison of the dent repair system 170 in FIGS. 3A and 3B illustrates how rotational articulation of the knob 188 can secure the dent repair gear 172 in place as well as allow for gear rotation while retaining the gear 172 within the handle. The ability to rotate the dent repair gear 172 without the gear 176 coming out of the handle allows a diverse variety of dent repair tools that are attached to the shaft 178 to be optimally utilized. For example, a dent repair tool with axial asymmetry can be utilized in a first position, rotated, and subsequently utilized in a second position with one hand and without removing the dent repair gear 172 from the handle. FIGS. 5A and 5B respectively are top and side view block representations of a portion of an example dent repair tool 200 configured in accordance with various embodiments to have axial asymmetry that provides a plurality of different shapes and surfaces to repair a surface deformation.

In FIG. 4A, a shaft 202 continuously extends into a tool body 204. Lateral protrusions 206 extend from the tool body 204 to provide a tool width 208 along the Y axis. The lateral protrusions 206 can have similar or dissimilar shapes, sizes, and number of edges that provide a uniform or varying length 210 that allows the engagement and repair of a dent by applying force to the dent. The ability to tune the shape and size of the tool body 204 and lateral protrusions 206 provides different leverage, forces, and tool surfaces to be applied to a dent to efficiently alter the dented vehicle panel. For example, the leading edge 212 of the tool 200 can be used to apply a broad area of coverage to a dent before, or during, the tool 200 is rotated with one hand to contact the dent with a different surface and portion of the tool 200.

The side profile view of the tool 200 illustrates how the shaft can have a thickness 214 along the Z axis that tapers to a smaller tip thickness 216. It is contemplated that the tapered surfaces 218 are present on less than the entire tool body 204 and lateral protrusions 206, such as a single lateral protrusion. Various embodiments configure at least a portion of the dent repair tool 200 with a uniform thickness plate portion that provides a square tip edge 220. The ability to tune the shape of the tool tip 222 between continuously linear and curvilinear surfaces, as shown in FIG. 4B, allows the tool 200 to be optimized for the application of force on small or large ranges of materials, types of dents, and dent sizes. Despite the ability to tune the size and shape of various portions of the dent repair tool 200, access and repair of some dents may not be possible or efficient with an axially asymmetrical configuration like that shown in FIGS. 4A and 4B.

With the shaft 202 of the dent repair tool 200 attached to a gear that can be selectively removed from a handle, as illustrated in FIGS. 3A and 3B, different dent repair tools can be easily interchanged with another tool that has a separate dent repair gear. FIG. 5 displays a side view block representation of a portion of an example dent repair tool 230 configured in accordance with some embodiments and capable of being implemented into a dent repair system, like the system 100 of FIG. 1A. The dent repair tool 230 has a shaft 232 connected to a tool tip 234 that is axially symmetric about the X axis.

Although the tool tip 234 can have any shape with any number of linear and curvilinear surfaces, the non-limiting embodiment shown in FIG. 5 configures the tool tip 234 with a shoulder portion 236 that has a uniform thickness along the Z axis that continuously extends into a tapered portion 238 that reduces the thickness of the shoulder portion 236 to a uniform thickness end cap portion 240. The presentation of multiple uniform thickness portions and a varying thickness portion can allow the dent repair tool 230 to apply force with small and large surface areas, which can be advantageous with smaller dents.

The tool tip 234 may, in some embodiments, be a different material than the shaft 232. While not required or limiting, the tool tip 234 can be fastened to the shaft 232 via a fastening means 242, such as with a pin, adhesive, magnets, and threads that extend into a recess in the shaft 232. Such fastening means 242 can allow for efficient interchanging of different tool tips 234, which can complement the ability to interchange a dent repair gear, shaft and tool tip collectively by removing the dent repair gear from the handle.

FIG. 6 provides a block representation of a portion of an example dent repair tool 250 constructed and operated in a dent repair system in accordance with various embodiments. A portion of a dent repair shaft 252 is shown in FIG. 6 and conveys how the shaft 252 can have multiple different angular orientations to present a tool tip end 254 at a different angle with respect to the X axis than a gear end 256 that is positioned proximal a dent repair gear. The shaft 252 can have a uniform or varying thickness along the Z axis that turns to provide a first angled portion 258 that is oriented 2 from the X axis and a second angled portion 260 that is oriented 3 from the X axis.

It is noted that the shaft 252 can be divided into any number of sections that are linear, curvilinear, or a combination of the two. The ability to tune the shaft with differently angled sections can optimize access and repair of a dent with one hand as additional leverage mechanisms, such as an additional hand, are replaced by the angled presentation of the tool tip fastening recess 262 compared to the gear end 256 of the shaft 252. With the efficient interchangeability of the tool tip, shaft, and dent repair gear, a dent repair system can be customized to a plethora of different combinations that can be adapted for the type of dent, vehicle panel material, and location of the dent to provide comfortable and efficient repair of the dent, which may involve rotating the gear and tool relative to the handle, with a single hand.

FIG. 7 depicts a perspective view block representation of a portion of a dent repair environment 270 in which an example dent repair system 272 can be employed to repair a dent in accordance with assorted embodiments. A portion of a vehicle 274 is displayed in FIG. 7, but in no way limits the type or size of the vehicle or the location of a repairable dent. As shown, a dent is present in a door 276 of the vehicle 274 and is accessed by extending portions of the dent repair system 272 through a window region 278 of the door 276 to access the backside of the dent.

While access and leverage to the dent in the door 276 may allow repositioning of the dent repair handle due to the space provided in the window region 278, using an additional hand to rotate handle and/or tool tip may be awkward and inefficient. For example, a user may use one hand to hold and manipulate the dent repair system while another hand works the door panel 276 or holds a light at one or more locations about the exterior of the dent. Hence, the ability to rotate the tool tip of the dent repair system with one hand optimizes the repair of a dent.

Figure 8:
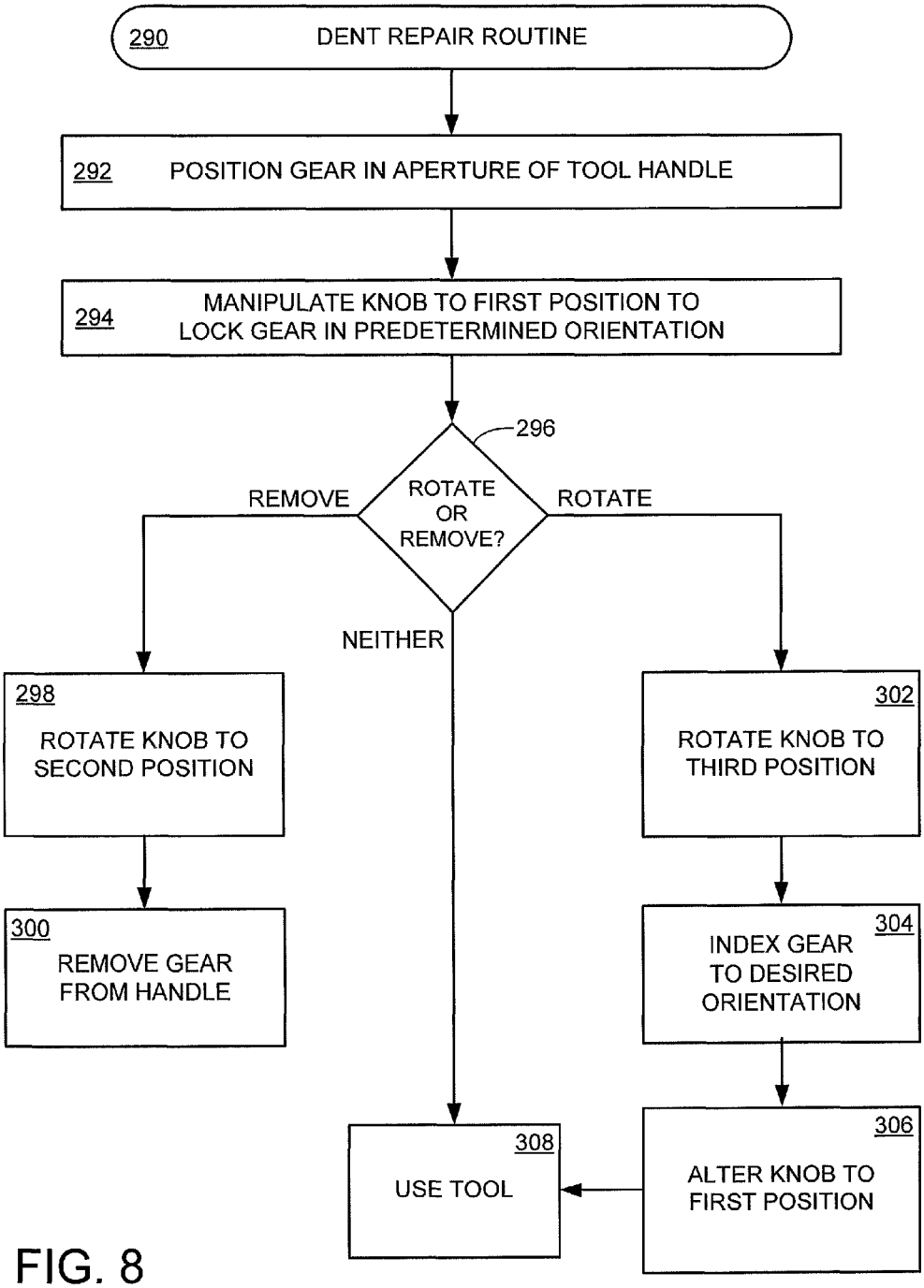
FIG. 8 plots an example dent repair routine that may be carried out in accordance with various embodiments.

It is contemplated that other dent locations, such as in a fender 280 or roof 282, can be particularly awkward to access and provide leverage to force a dent to deform and repair, which supports the increase in dent repair comfort, speed, and accuracy provided by the dent repair system where one-handed operation of the handle can rotate and reposition a tool tip of the system relative to the dent. FIG. 8 is a flowchart of an example dent repair routine 290 that can be conducted in accordance with various embodiments. Anytime after a dent has deformed one or more surfaces of a vehicle body, step 292 can position a dent repair gear in an aperture of a dent repair handle. It is assumed that the dent repair tool consists of at least one shaft and tool, but such configuration is not required or limiting.

Step 294 next manipulates a knob of the dent repair handle to a first position to lock the gear in place by concurrently contacting retention ring and engagement surfaces of the gear. It is understood that the dent repair tool can be continuously, sporadically, and randomly operated as is. However, the tuned configuration of the various aspects of a dent repair system in accordance with various embodiments allows the dent repair gear to be rotated within the handle or removed from the handle. Decision 296 determines if the dent repair gear, as attached tool, are to be rotated or removed. Removal of the dent repair gear triggers step 298 to use only one hand to rotate the handle knob to a second position where the retention feature is disengaged from the retention ring and engagement surfaces of the dent repair gear to allow the gear to exit the handle aperture in step 300.

In the event decision 296 chooses to rotate the dent repair gear, step 302 rotates the knob of the handle to a third position, such as the position illustrated in FIG. 3B, with only one had, which corresponds with rotation of the gear while retaining the gear within the handle aperture by contacting the retention ring. Next, step 304 indexes the dent repair tool and corresponding dent repair tool to a desired orientation with respect to the handle. In response to the gear and tool being oriented in a satisfactory position, step 306 secures the gear in place by rotating the knob back to the first position with only one hand to engage the retention ring and engagement surfaces of the gear before step 308 uses the tool to apply force on the dent to repair the corresponding vehicle panel.

Through the various embodiments of the dent repair gear, handle, shaft, and tool and the operation of the dent repair system provided by routine 290, a user can utilize and customize the dent repair tool to optimize the access to and repair of at least one dent. However, routine 290 is not limited to the steps and decisions displayed in FIG. 8 as the various aspects can be changed, omitted, or moved and additional steps and decisions can be added, at will. For instance, a different dent repair gear, shaft, and tool can be inserted into and secured by the dent repair handle subsequent to the removal of the initial dent repair gear in step 300.

With the tuned configuration of a dent repair system, a gear, shaft, and tool can be secured, released, and rotated via one-handed operation of a handle knob. The ability to release, rotate, and resecure a dent repair gear and tool in a different orientation relative to the tool handle with one hand allows different aspects of the dent repair tool to be used to contact and correct a dent efficiently and comfortably. The interchangeability of dent repair tools further allows a diverse variety of dent repair tool configurations that can cater to different types of dents, dent locations, and dent sizes. The tuned configuration of the dent repair tool can provide axially symmetric and asymmetric shapes of various sizes that can utilize one-handed rotation to efficiently apply force to a dent, particularly in tight and awkward locations.

It is to be understood that even though numerous characteristics and advantages of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. An apparatus comprising:

a handle comprising a housing with an aperture;

a stationary plug positioned on a first side of the aperture within the housing, the stationary plug having a plug surface and a plug recess;

a retention feature positioned on a second side of the aperture within the housing, opposite the stationary plug, the retention feature having a retention surface and a retention notch;

a gear comprising a cylindrical shaped body having first and second end surfaces, the gear positioned in the aperture between the stationary plug and retention feature;

a retention ring continuously extending around the periphery of the cylindrical shaped body between the first and second end surfaces, the retention ring having a sidewall that continuously extends from the cylindrical shaped body in a radial direction with respect to the cylindrical shaped body, the retention ring physically retained in the housing via contact with the plug recess and retention recess, the retention ring configured to rotate within the housing via a physical separation between the cylindrical shaped body and both the stationary surface and the retention surface; and a tool continuously extending from the body via a shaft.

2. The apparatus of claim 1, wherein the housing is hollow.

3. The apparatus of claim 1, wherein the retention ring is separated from the first and second end surfaces.

4. The apparatus of claim 3, wherein the retention ring is positioned closer to the first end surface than the second end surface.

5. The apparatus of claim 1, wherein the sidewall is continuously curvilinear and has a rectangular cross-section.

6. The apparatus of claim 1, wherein the cylindrical shaped body tapers to the second end surface.

7. The apparatus of claim 1, wherein the shaft tapers to a pry-bar plate distal the body.

8. The apparatus of claim 7, wherein the pry-bar plate has a width that is greater than the shaft and a thickness that is less than the shaft.

9. The apparatus of claim 1, wherein the shaft has a curved portion angled with respect to a linear portion, the linear portion proximal the body.

10. An apparatus comprising:

a handle comprising a housing with an aperture;

a stationary plug positioned on a first side of the aperture within the housing, the stationary plug having a plug surface and a plug recess;

a retention feature positioned on a second side of the aperture within the housing, opposite the stationary plug, the retention feature having a retention surface and a retention notch;

a gear comprising a cylindrical shaped body having first and second end surfaces on opposite sides of a cylindrical shaped body, the gear positioned in the aperture between the stationary plug and retention feature, the cylindrical shaped body comprising a plurality of linear surfaces oriented in different directions throughout a periphery of the cylindrical shaped body;

a retention ring continuously extending around the periphery of the cylindrical shaped body between the first and second end surfaces, the retention ring having a sidewall that continuously extends from the cylindrical shaped body in a radial direction with respect to the cylindrical shaped body, the retention ring physically retained in the housing via contact with the plug recess and retention recess, the retention ring configured to rotate within the housing via a physical separation between the cylindrical shaped body and both the stationary surface and the retention surface; and a tool continuously extending from the cylindrical shaped body via a shaft to present a dent repair tool.

11. The apparatus of claim 10, wherein the plurality of linear surfaces surround the cylindrical shaped body.

12. The apparatus of claim 10, wherein each linear surface of the plurality of linear surfaces is planar.

13. The apparatus of claim 10, wherein the plurality of linear surfaces are present on opposite sides of the retention ring.

14. The apparatus of claim 10, wherein the plurality of linear surfaces form an octagon about the cylindrical shaped body.

15. The apparatus of claim 10, wherein the plurality of linear surfaces extend a first radial distance from a longitudinal axis of the cylindrical shaped body, the retention ring extending a second radial distance from the longitudinal axis of the cylindrical shaped body, the second radial distance being greater than the first radial distance.

16. The apparatus of claim 10, wherein the shaft has a first cross-sectional shape and continuously extends along a longitudinal axis of the cylindrical shaped body beyond the cylindrical shaped portion of the cylindrical shaped body, the shaft having a reduced thickness portion having a second cross-sectional shape, the first and second cross-sectional shapes being different.

17. A method comprising:

engaging an aperture of a housing of a handle with a gear, the gear having first and second end surfaces on opposite sides of a cylindrical shaped body, the cylindrical shaped portion comprising a plurality of linear surfaces oriented in different directions throughout a periphery of the cylindrical shaped body, the cylindrical shaped body having a retention ring continuously extending around the periphery of the cylindrical shaped body between the first and second end surfaces, the retention ring having a sidewall that continuously extends from the cylindrical shaped body in a radial direction with respect to the cylindrical shaped body;

contacting the retention ring with a stationary notch of a stationary plug and a retention notch of a retention feature, the stationary plug and retention feature respectively positioned on opposite sides of the aperture and gear within the handle, the plurality of linear surfaces being physically separated from a stationary surface of the stationary plug and a retention surface of the retention feature first notch touching the retention ring and at least two of the plurality of linear surfaces, the second notch touching the retention ring without touching any linear surfaces of the plurality of linear surfaces;

rotating the gear within the aperture of the handle while the stationary and retention notches concurrently contact the retention ring; and repairing a dent of a vehicle with a tool continuously extending from the gear via a shaft.

18. The method of claim 17, wherein the retention ring is maintained in the aperture of the handle via contact of the retention ring sidewall with the stationary and retention notches.

19. The method of claim 17, further comprising manipulating a portion of the handle so that the retention notch concurrently contacts the retention ring and at least two linear surfaces of the plurality of linear surfaces to orient the tool in a predetermined orientation with respect to the handle.

20. The method of claim 19, wherein engagement of the retention ring with the stationary and retention notches prevents removal of the gear from the aperture and housing.

* * * * *